United States Patent [19]

Helms

[11] Patent Number: 4,941,405

[45] Date of Patent: Jul. 17, 1990

[54] DRIVING MECHANISM FOR RECIPROCATING PRINT SHUTTLE

[75] Inventor: Cliff Helms, Temecula, Calif.

[73] Assignee: Dataproducts Corporation, Woodland Hills, Calif.

[21] Appl. No.: 133,556

[22] Filed: Dec. 16, 1987

[51] Int. Cl.[5] ..... B41J 3/10

[52] U.S. Cl. ..... 101/93.04; 400/323

[58] Field of Search ..... 400/121, 124, 320, 322, 400/323, 328, 341; 101/93.04, 93.05, 93.11

[56] References Cited

U.S. PATENT DOCUMENTS

| | | | |
|---|---|---|---|
| 3,941,051 | 5/1976 | Barrus et al. | 101/93.04 |
| 3,976,923 | 8/1976 | Firtion et al. | 318/128 |
| 4,180,766 | 12/1979 | Matula | 101/93.04 |
| 4,239,403 | 12/1980 | Matula et al. | 101/93.02 |
| 4,278,019 | 7/1981 | Meier | 101/93.04 |
| 4,294,551 | 10/1981 | Chehovah | 400/119 |
| 4,359,289 | 11/1982 | Barrus et al. | 400/322 |
| 4,359,937 | 11/1982 | Helinski | 101/93.04 |
| 4,387,642 | 6/1983 | Bringhurst et al. | 101/93.04 |
| 4,402,620 | 9/1983 | Kekas et al. | 400/121 |
| 4,637,307 | 1/1987 | Miller | 101/93.04 |
| 4,741,267 | 5/1988 | Lipkouker et al. | 101/93.04 |
| 4,749,294 | 6/1988 | Barrus et al. | 400/322 |
| 4,764,040 | 8/1988 | Whitaker | 101/93.04 |

FOREIGN PATENT DOCUMENTS

| | | |
|---|---|---|
| 55-9852 | 1/1980 | Japan . |
| 55-9853 | 1/1980 | Japan . |
| 56-10475 | 2/1981 | Japan . |
| 56-19775 | 2/1981 | Japan . |
| 56-27358 | 3/1981 | Japan . |
| 57-93166 | 6/1982 | Japan . |
| 57-125077 | 8/1982 | Japan . |
| 58-20468 | 2/1983 | Japan . |
| 58-31770 | 2/1983 | Japan . |
| 58-36470 | 3/1983 | Japan . |
| 58-89378 | 5/1983 | Japan . |
| 58-89379 | 5/1983 | Japan . |
| 58-112757 | 7/1983 | Japan . |
| 58-118269 | 7/1983 | Japan . |
| 58-163673 | 9/1983 | Japan . |
| 59-64366 | 4/1984 | Japan . |
| 59-93359 | 5/1984 | Japan . |
| 59-95165 | 6/1984 | Japan . |
| 59-96974 | 6/1984 | Japan . |
| 59-98870 | 6/1984 | Japan . |
| 59-146876 | 8/1984 | Japan . |
| 59-229353 | 12/1984 | Japan . |
| 60-13560 | 1/1985 | Japan . |
| 60-15170 | 1/1985 | Japan . |

*Primary Examiner*—David A. Wiecking

*Attorney, Agent, or Firm*—Spensley Horn Jubas & Lubitz

[57] ABSTRACT

A shuttle assembly comprises a first mass, including printheads, connected by springs to a second mass. Both masses are suspended for low friction long-stroke linear oscillation on bearing rollers. A small electromagnetic drive force from a frame-mounted voice coil is coupled to the first mass so that it will ultimately assume, and thereafter maintain, linear oscillation at a natural resonant frequency. The second mass is symmetrically connected, thereby inducing but an extremely minor net moment of force about the shuttle center of mass. The shuttle assembly is internally force-balanced and couples, through the small drive forces, but very small forces to the machine frame. A control circuit maintains resonant sinusoidal oscillation in a manner insensitive to printing impacts or outside disturbances by sensing shuttle velocity and position in a phase-locked loop.

39 Claims, 9 Drawing Sheets

DRIVING MECHANISM FOR RECIPROCATING PRINT SHUTTLE

BACKGROUND OF THE INVENTION

1. Field of the Invention.

This invention relates to printers, and more particularly, to reciprocating shuttles for such printers.

2. Description of Related Art.

Printing or plotter heads are often moved in a reciprocating motion in order to print a line of characters on a sheet of workpiece paper. Various types of printing heads have been so employed. See, for example, U.S. Pat. Nos. 3,951,051 to Barrus, et al., 4,180,766 to Matula, 4,239,403 to Matula et al., 4,359,289 to Barrus and Japanese Patent Publications Nos. 57-93166 and 58-89378, all of which are incorporated herein by reference.

In some of the previous printer devices, a reciprocating shuttle carriage which supports the printing head is driven by very high drive forces relative to the printer frame. The frames of such printers generally have massive components to accommodate such drive forces but nonetheless tend to vibrate during operation. Prior drive mechanisms often use tight linkage systems which have been found to transmit much of the oscillatory force to the printer frame. Furthermore, designers of many prior printers have attempted to overcome non-resonant oscillating forces by using a considerably larger opposing force, which has often compounded the vibrational force exerted on the machine frame.

The additional extraneous forces often present with prior devices can significantly increase the amount of acceleration on the printheads. This is particularly true if the shuttle stroke is relatively short because more oscillations per line printed are often required with short stroke shuttles. It has been found that high acceleration can interfere with the proper operation of the ink supply.

SUMMARY OF THE INVENTION

According to the present invention, a long-stroke force-balanced resonantly reciprocating shuttle mechanism is provided that overcomes these and other problems of prior devices. The mechanism of the present invention is capable of resonantly oscillating a shuttle of several kilograms over a distance of several centimeters at a frequency of several hertz with uniformity, smoothness and repeatability.

The shuttle of the illustrated embodiment comprises a carriage fixedly supporting one or more printheads. The carriage is supported on the mechanism frame for reciprocal linear motion. A counterbalancing mass is attached by springs to the shuttle. In an alternate embodiment of the present invention, the counterbalancing mass has two parts symmetrically disposed above and below the shuttle.

In one aspect of the present invention, the shuttle and counterbalancing mass are interconnected by springs in such a manner as to form an internally force-balanced system. Each mass moves at an equal, and opposite, displacement and velocity relative to the other mass so that no net moment of force is induced about the center of mass of the shuttle. The printer frame allows the shuttle and the counterbalancing mass to move in a low friction, linear reciprocating motion. The drive force required is weak relative to the acceleration forces produced within the shuttle by the springs. As a result of the low externally supplied drive force required to maintain steady oscillation, the drive power requirements are very low.

The reciprocation of the shuttle has a relatively long stroke but produces relatively low acceleration forces on the printheads. Printing, plotting or other such activities may be accomplished at very high speeds with precise registration, but the force required to maintain the linear oscillation is small so that neither the mechanism frame nor a cabinet housing the printer experiences significant vibrational force or torque.

In accordance with another aspect of the present invention, a feedback shuttle drive control system in combination with a drive system for the shuttle maintains the oscillation at the resonant frequency of the shuttle and counterbalancing mass. In the illustrated embodiment, a dual capacitor position sensor generates a signal corresponding to the position of the oscillating carriage. That signal, which is a sine wave, is provided to control circuitry which accepts the sine wave as a position signal of the carriage and, in a phase-locked loop, feeds back signals to an electromagnetic motor for controlled application of the drive force to control and maintain the resonant frequency oscillation. The electromagnetic motor provides sufficient force to overcome frictional losses and to urge the shuttle into resonant oscillation as determined by the mechanical parameters of the shuttle. Because of the control accorded by the feedback control circuit, the shuttle undergoes smooth and uniform oscillatory motion.

BRIEF DESCRIPTION OF THE DRAWINGS

The invention may be better understood by reference to the following Detailed Description in conjunction with the attached drawings wherein.

DETAILED DESCRIPTION

Figure 1:
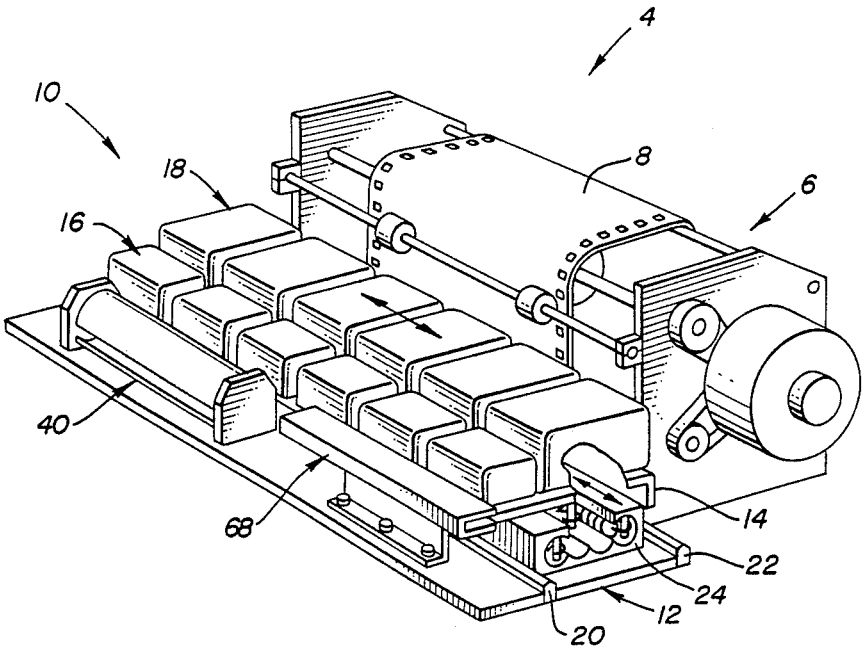
FIG. 1 is a perspective view of one embodiment of a long-stroke reciprocating shuttle mechanism constructed in accordance with the present invention.

Referring now to the drawings and more particularly to FIG. 1, a perspective view of a printer 4 constructed in accordance with one embodiment of the present invention is shown. The printer 4 comprises a frame 6 having a workpiece 8 such as multi-web printer paper mounted thereon. A long-stroke reciprocating shuttle mechanism 10 constructed in accordance with a preferred embodiment of the present invention is carried on the machine frame 6. The shuttle mechanism 10 comprises a mounting base 12 that supports a shuttle carriage 14 which moves in a reciprocating linear movement in the direction of the arrows of FIG. 1, and a counterbalancing mass 24. A predetermined number of sets of ink chambers 16 and printheads 18 is affixed to the top of the carriage 14. The number of printheads 18 fixed on the carriage 14 depends on numerous factors including the width of the surface to be printed, the length of the stroke of the carriage 14, and the desired resolution of the printed characters.

The printheads 18 may comprise, for example, ink jet printheads, dot matrix printheads or plotting printheads and are directed to print or plot on the workpiece 8 when the shuttle carriage 14 is linearly reciprocated in front of the workpiece 8. As the carriage 14 reciprocates in front of the workpiece 8, control circuitry of the shuttle mechanism 10 (not shown) determines the position and velocity of the printheads 18 and actuates the printheads 18 at the appropriate instant to effect printing onto the workpiece 8 at very high speeds with very accurate registrations as is known in the art.

Figure 2:
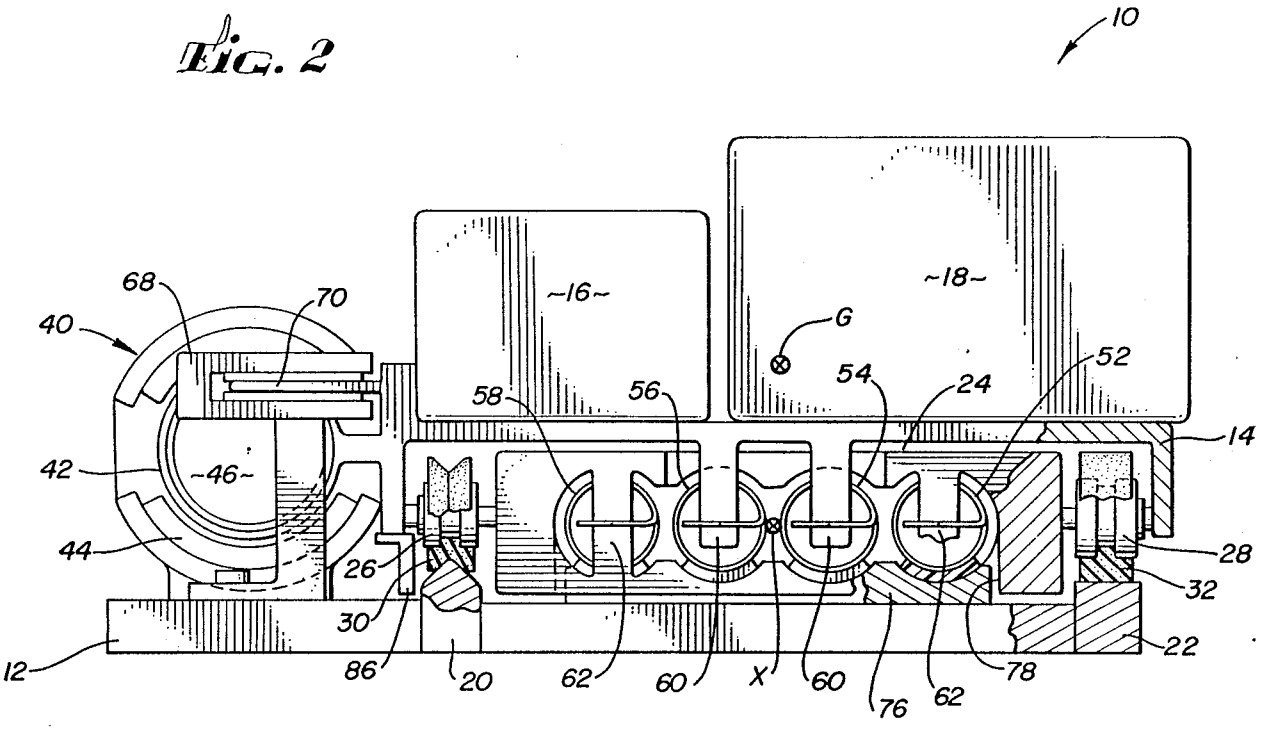
FIG. 2 is an end view of the mechanism of FIG. 1.
Figure 3:
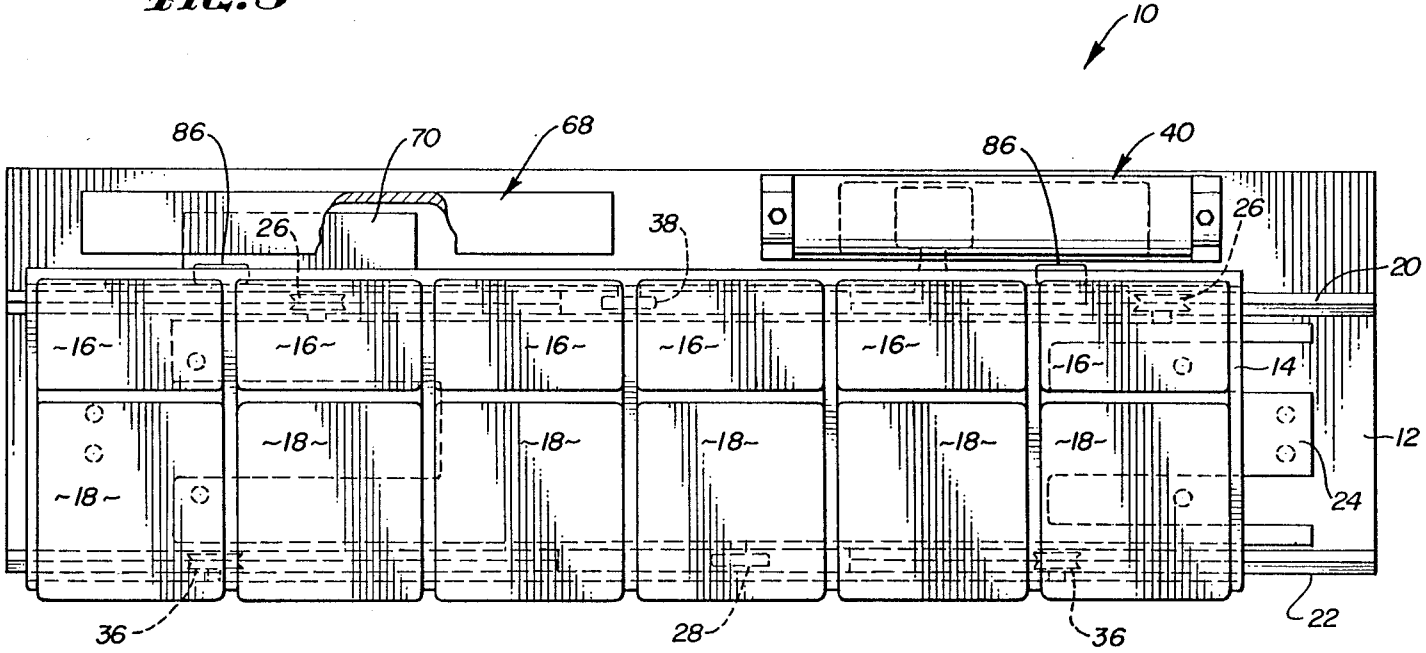
FIG. 3 is a top view of the mechanism of FIG. 1.
Figure 4:
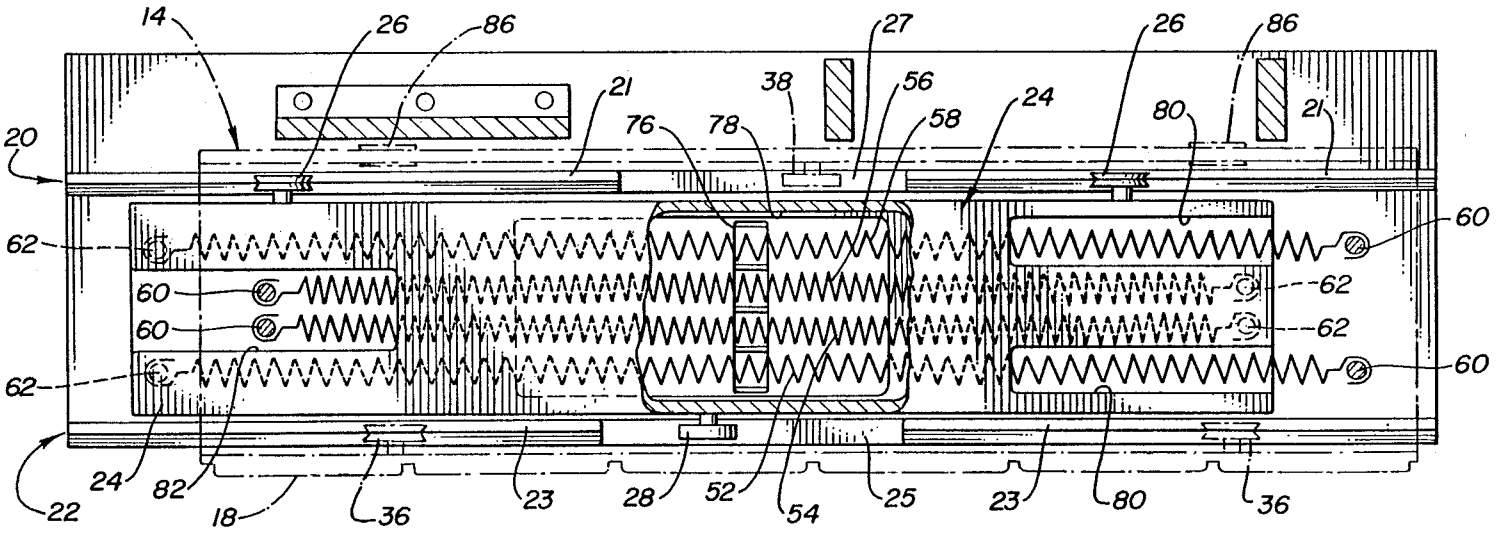
FIG. 4 is a top view of the mechanism of FIG. 1 showing the resonant masses and connecting springs with the carriage omitted.

A more complete understanding of the construction of the shuttle mechanism 10 of FIG. 1 may be had by reference to FIGS. 2–4. A pair of rails 20 and 22 are fixed longitudinally along the base 12 for supporting the carriage 14 and the mass 24 for counterbalancing the oscillation of the carriage 14. The mass 24 also linearly reciprocates in the direction of the arrows of FIG. 1 but when the carriage 14 and mass 24 are oscillating at a natural resonant frequency the motion of the mass 24 is in the opposite direction of the motion of the carriage 14.

The top surfaces of the longitudinal ends of the rails 20 and 22 form bearing surfaces 21 and 23 having an inverted "V" cross-sectional shape. The top surfaces of the interior portions of the rails 20 and 22 form flat bearing surfaces 25 and 27.

Supporting one side of the mass 24 are two bearings 26, only one of which is shown in FIG. 2. Each of the bearings 26 rests on one of the V-shaped surfaces 21 of the rail 20. Part of the carriage 14 is shown cut-away in FIG. 2 to reveal a bearing 28 on the flat surface 25 in the interior of the rail 22 supporting the other side of the mass 24. Each bearing 26 has an elastomeric tire 30 having a cross-sectional shape for mating engagement with the top surface of the ends of the rail 20. The bearing 28 has an elastomeric tire 32 having a flat cross-sectional shape for mating engagement with the interior surface 25 of the opposite rail 22. The mass is thus supported at the ends on rail 20 by two V-shaped tires 30 and in the middle of the rail 22 by a flat cross-sectional shaped tire 32. The bearings 26 and 28 thereby form a three-point suspension system for the mass 24.

As shown in FIGS. 3 and 4, two bearings 36 rest on the V-shaped surfaces 23 on the opposite longitudinal ends of the rail 22 to support one side of the carriage 14. A bearing 38 on the flat surface 27 in the interior of the rail 20 supports the other side of the carriage 14. Each bearing 36 has an elastomeric tire 30 having a cross-sectional shape for mating engagement with the top surface of the rail 22. The bearing 38 has an elastomeric tire 32 having a flat cross-sectional shape for mating engagement with the interior of the second rail 20. The bearings 36 and 38 thereby form a three-point suspension system for the carriage 14 similar to the suspension system for the mass 24. The carriage is thus supported at the ends on rail 22 by two V-shaped tires 30 and in the middle of the rail 20 by a flat cross-sectional shaped tire 32. The relative positions of the bearings 26, 28, 36 and 38 may be more fully understood by referring to FIGS. 3 and 4.

As shown in FIGS. 1, 2, 3 and 4, but perhaps best shown in FIG. 2, a linear voice coil motor 40 mounted on the base 12 comprises a coil 42 mounted on the carriage 14, motor magnets 44 and a core 46. The motor 40, coil 42, magnets 44 and core 46 interact electromagnetically to drive the carriage 14 at a resonant frequency as more fully described below.

Referring to FIGS. 2 and 4, the counterbalancing mass 24 beneath the carriage 14 is mechanically coupled to the carriage 14 by springs 52, 54, 56 and 58 so that the mass 24 will counterbalance the oscillatory motion of the carriage 14, ink chambers 16 and printheads 18. The springs 52, 54, 56 and 58 are connected to the carriage 14 by four carriage pins 60 and to the mass 24 by four mass pins 62, only two of each of which are shown in FIG. 2. When the carriage 14 oscillates at a natural resonant frequency in front of the workpiece, the springs 52, 54, 56 and 58 cause the mass 24 to oscillate at the same frequency but in the opposite phase or moving in the opposite direction as the carriage 14 to counterbalance the motion of the carriage 14. Most of the mechanical energy of the oscillating system is thereby stored in the springs 52, 54, 56 and 58 at the extremes of the carriage 14 and mass 24 travels.

FIG. 3 depicts a top view of the mechanism of FIG. 1. FIG. 4 depicts a top view of the mechanism of FIG. 1 showing the counterbalancing mass 24 and connecting springs 52, 54, 56 and 58 but with the carriage 14 shown only in dotted lines. Different relative positions of the mass 24 and the carriage 14 due to oscillation are depicted in FIGS. 3 and 4. As is best shown in FIG. 4, the outer springs 52 and 58 are coupled to the carriage 14 at one end and to the mass 24 at the other end. Conversely, the inner springs 54 and 56 are connected to the mass 24 at the one end and to the carriage 14 at the other end. Consequently, during resonant oscillation of the carriage 14 and the mass 24, as the opposing movement of the carriage 14 and mass 24 causes the outer springs 52 and 58 to expand, the inner springs 54 and 56 contract. Conversely, when the outer springs 52 and 58 contract, the inner springs 54 and 56 expand. As a result, the center portions of the springs 52, 54, 56 and 58 do not substantially move.

When the mechanism 10 is not operating, the springs 52, 54, 56 and 58 are attached to the carriage 14 and mass 24 and held in tension so that neither the carriage 14 nor the mass 24 moves. When the carriage 14 and mass 24 are each at either end of their respective travels, the tension on the springs 52, 54, 56 and 58 is sufficient that even the contracted springs still have a slight expanded tension. Also, each of the springs 52, 54, 56 and 58 of the shuttle mechanism 10 has an unstretched length sufficient to accommodate the stroke length of the shuttle carriage 14. Thus, none of the springs 52, 54, 56 or 58 is over expanded or contracted but are always under some expanded tension. Furthermore, the use of four springs in parallel reduces the stress per unit volume on any individual spring. This disperses the stress and reduces the chance of spring breakage.

When the carriage 14 and mass 24 are oscillating at a natural resonant frequency, the following cycle is repeated. The carriage 14 moves in a first direction and the mass 24 moves in the opposite, second direction at approximately the same speed. The movement of the carriage 14 and mass 24 is promoted by the contraction of one pair of springs, for instance, springs 52 and 58, and opposed by the consequent expansion of the other pair of springs, in this case springs 54 and 56. The kinetic energy of the carriage 14 and mass 24 is therefore converted into potential energy stored in the springs 54 and 56. That energy causes the carriage 14 and mass 24 to slow and reverse directions so that the carriage 14 begins to move in the second direction and the mass 24 begins to move in the first direction. In this manner, the potential energy stored in the springs 54 and 56 is connected to the kinetic energy represented by the motion of the carriage 14 and mass 24. However, the movement of the carriage 14 and mass 24 is resisted by the springs 52 and 58 and thus the kinetic energy of the carriage 14 and mass 24 is again converted into potential energy that is stored in the springs 52 and 58. When the kinetic energy of the carriage 14 and mass 24 reaches zero (i.e. when the carriage 14 and mass 24 reach the other respective end of their travel), the energy of the system is stored substantially all in the springs 52 and 58. The potential energy stored in the springs 52 and 58 then causes the carriage 14 to again move in the first direction and causes the mass 24 to move in the opposite, second direction, thereby completing the cycle. Any friction in the system that may tend to retard the resonant oscillation is overcome by energy from the motor 40 as described below.

A position sensor 68 on the base 12 interacts electrostatically with a sensor fin 70 mounted on the carriage 14 to indicate the position of the carriage 14 at any given instant. The control circuitry uses a signal from the position sensor 68 to maintain the resonant oscillation of the carriage 14 as discussed below with respect to FIGS. 9 and 10.

A base-mounted spring support 76 is positioned within a relief area 78 in the bottom of the counterbalancing mass 24 to dampen the lowest transverse and longitudinal vibration frequencies the springs 52, 54, 56 and 58 acquire during expansion and contraction. The spring support 76 is at the neutral point in the springs where the coils of the springs remain relatively motionless and is preferably lined with polytetraflouroethylene or silicon rubber to eliminate appreciable friction losses. Two cutout areas 80 and a single cutout area 82 at opposite ends of the mass 24 allow the carriage pins 60 and mass pins 62 to pass through part of the mass 24 when the carriage 14 and mass 24 are oscillating.

The springs 52, 54, 56, and 58 act along the center of gravity of the mass 24 and therefore do not produce a substantial moment which would tend to rotate the mass 24. However, in the illustrated embodiment, the springs act below the center of gravity of the carriage 14 and therefore can produce a moment about the carriage 14. This moment is not large enough to induce substantial machine frame vibrations but could cause the carriage 14 to lift off its bearings. As a result, magnets 86 may be provided to pull the carriage 14 toward the base 12 and thereby overcome the effect of such a moment induced about the carriage 14.

The drive force required by the shuttle mechanism 10 for a given stroke length is at a minimum when the drive frequency is the same as the natural resonant frequency of the mechanism 10. The natural resonant frequency is a fundamental property of the mechanical system and is a function of the carriage 14, the mass 24 and the spring forces interconnecting those masses. To minimize the size and power of the motor 40, the carriage 14 is preferably oscillated at a drive frequency that is within about one percent, and possibly as close as one tenth of one percent, of the natural resonant frequency of the shuttle mechanism 10. The degree of necessary control of the position and velocity of the carriage 14 depends on the printing accuracy required and the means used to control the firing of the printheads.

Although the mass of the shuttle mechanism 10 may be considerable, and although the carriage 14 may reciprocate over a linear distance of several centimeters at a rate of several cycles per second, the principal accelerating forces are provided by the spring forces internal to the shuttle mechanism 10. Because the shuttle mechanism 10 is internally force-balanced and provides cancellation of extraneous moment forces, smooth resonant linear oscillation occurs. Consequently, the magnitude of the oscillations undergone by the carriage 14 may be quite large without inducing significant vibration of the machine frame 6. Because little or no significant forces are exerted on the machine frame 6, a light-weight machine frame 6 experiences little appreciable vibration or force.

The center of force resulting from attachment of the shuttle carriage 14 to the counterbalancing mass 24 is marked by an X in FIG. 2. The center of gravity is marked by a G. During oscillation of the mechanism 10 shown in FIGS. 1, 2, 3, and 4, the vertical displacement between the center of force and the center of gravity creates a small moment arm that induces a small rotational force in the vertical plane. The rotational force creates a torque in the vertical plane that is applied through the mounting base 12 to the floor. No appreciable forces are coupled to the base 12 during oscillation. Thus, no appreciable vibration occurs due to the minor force imbalance in the vertical plane and the entire assembly operates with improved smoothness and quietness.

The mechanism 10 may be used for any type of printing involving a reciprocating shuttle. For instance, the reciprocating carriage 14 may be used in a plotter, in an ink jet or dot matrix printer. The printheads 18 are those designed for printing and/or plotting. The ink may be connected to the printheads 18 through flexible rubber hoses to allow large scale printing without stopping to change or add ink. Such a system also avoids disrupting the resonant oscillation because use of ink in a container on the carriage 14 will cause a drop in the mass on the carriage 14 due to a drop in ink mass.

Figure 5:
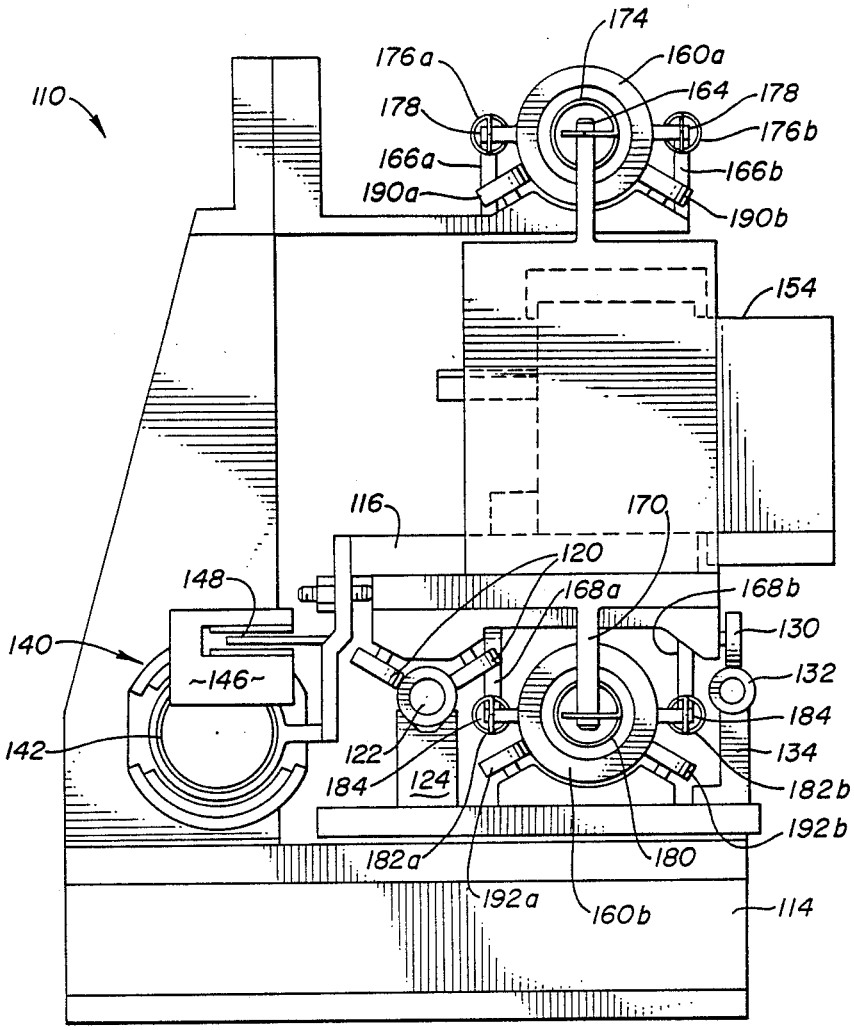
FIG. 5 is an end view of an alternative embodiment of a long-stroke reciprocating shuttle mechanism according to the present invention.
Figure 6:
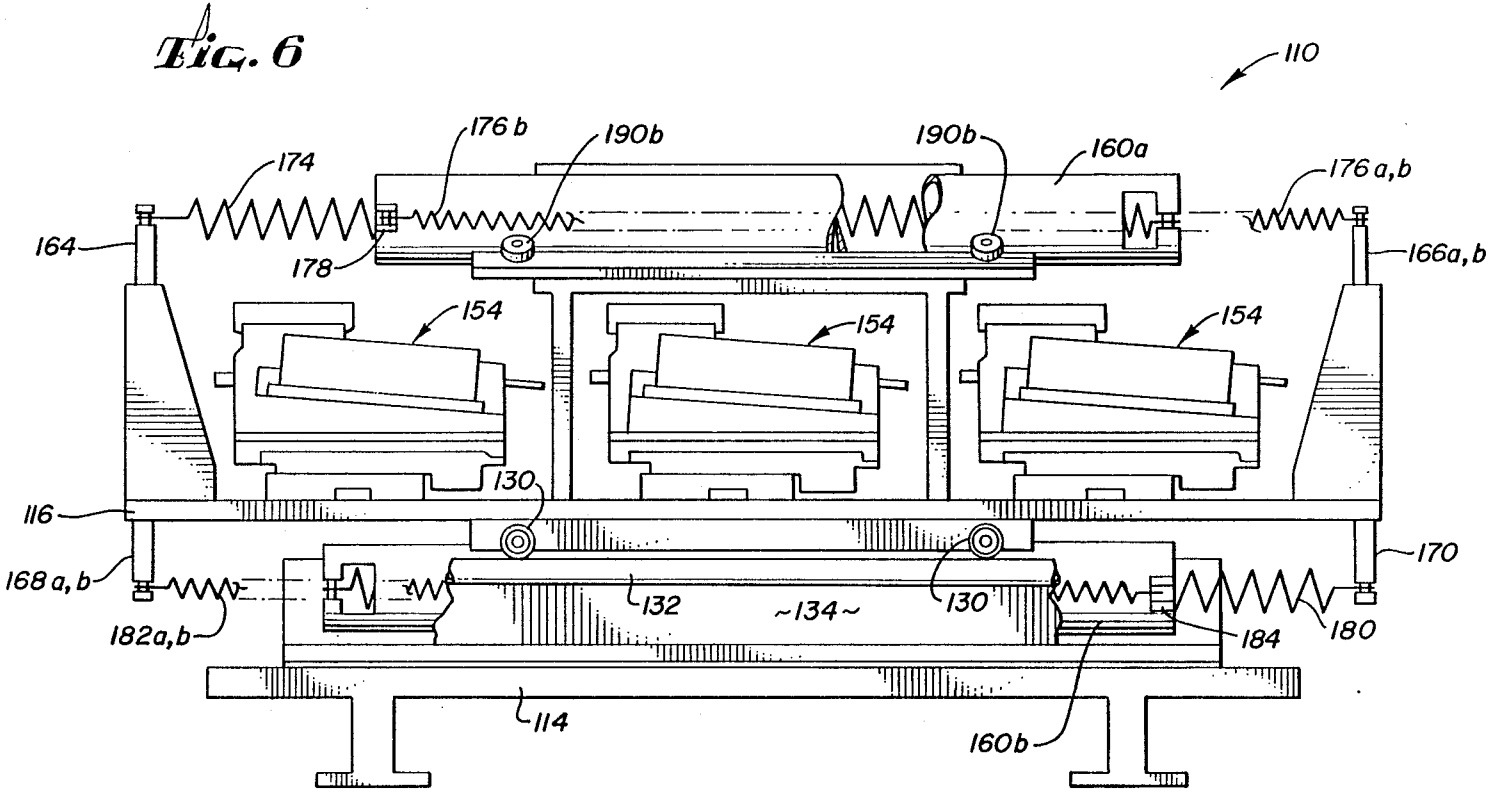
FIG. 6 is a side view of the embodiment of FIG. 5.

FIGS. 5 and 6 depict the construction of a second embodiment of the invention wherein a long-stroke reciprocating shuttle mechanism 110 comprises a base 114 having a shuttle carriage 116 mounted thereon. The mechanism 110 operates in generally the same fashion as the mechanism 10. One side of the shuttle carriage 116 is supported for linear movement by two pairs of roller bearings 120, only one pair of which is shown in FIG. 5, that engage a cylindrical support tube 122 which is connected to the base 114 by way of a support structure 124. A pair of bearings 130 acting on a support cylinder 132 support the other side of the carriage 116 for linear movement. A support structure 134 connects the support cylinder 132 to the base 114.

A motor 140 drives the carriage 116 by way of a linear voice coil and core assembly 142 in accordance with a drive signal as described below. A position sensor 146 interacts with a sensor fin 148 to determine the position of the carriage 116 as discussed below.

A plurality of ink jet printhead assemblies 154 are mounted on top of the carriage 116. In alternate embodiments of the invention, the assemblies 154 may comprise plotter printheads, dot matrix printheads, or other such devices. The assemblies 154 and shuttle carriage 116 form a first mass. Cylinders 160(*a*) and 160(*b*) disposed above and below the carriage 116 form a second mass divided into two equal parts to counterbalance the oscillation of the first mass.

Referring now to FIG. 6, the shuttle carriage 116 has six stanchions 164, 166*a*, 166*b*, 168*a*, 168*b*, and 170 secured thereon to enable coupling of the carriage 116 to the cylinders 160*a* and 160*b*. The upper cylinder 160*a* is attached to the carriage stanchion 164 by way of a spring 174 internally running the entire length of the cylinder 160*a* and attached to the cylinder at 165. Two parallel springs 176*a* and 176*b* are attached to external connection points 178 on the cylinder 160*a* (see FIG. 5) and run externally along the length of, and generally displaced from the diameter of, the cylinder 160*a* to the stanchions 166*a* and 166*b*. The spring constant of the spring 174 is substantially equal to the combined spring constants of the springs 178*a* and 178*b*. In an alternate embodiment, the spring 176 is actually two springs that are similar to the springs 178*a* and 178*b*.

Likewise, the lower cylinder 160*b* is connected to the stanchion 170 by way of a spring 180 running internally the entire length of the cylinder 160*b*. The cylinder 160*b* is externally attached to the stanchions 168*a* and 168*b*by two parallel springs 182*a* and 182*b* that run from connection points 184 on the cylinder 160*b* (see FIG. 5) externally along the length of, and generally displaced from the diameter of, the cylinder 160*b*. The spring constant of the spring 180 is approximately equal to the combined spring constants of the springs 182*a* and 182*b*. In an alternate embodiment, the spring 180 is actually two springs that are similar to the springs 182*a* and 182*b*. The springs 174, 176*a*, 176*b*, 180, 182*a* and 182*b* provide the spring force by which the second mass comprising the cylinders 160*a* and 160*b* is coupled to the first mass comprising the carriage 116 and printhead and driver assemblies 154.

Bearings 190*a* and 190*b* support the upper cylinder 160*a* for linear movement relative to the upper part of the base 114. Bearings 192*a* and 192*b* support the lower cylinder 160*b* for linear movement relative to the base 114.

In this embodiment, the springs are attached to the carriage 116 so that the net spring forces are effectively applied along the center of gravity of both the carriage 116 and the symmetrically located counterbalancing cylinders 160*a* and 160*b*. Consequently, there are no unbalanced forces or moments such as may be present in the first embodiment.

Figure 7:
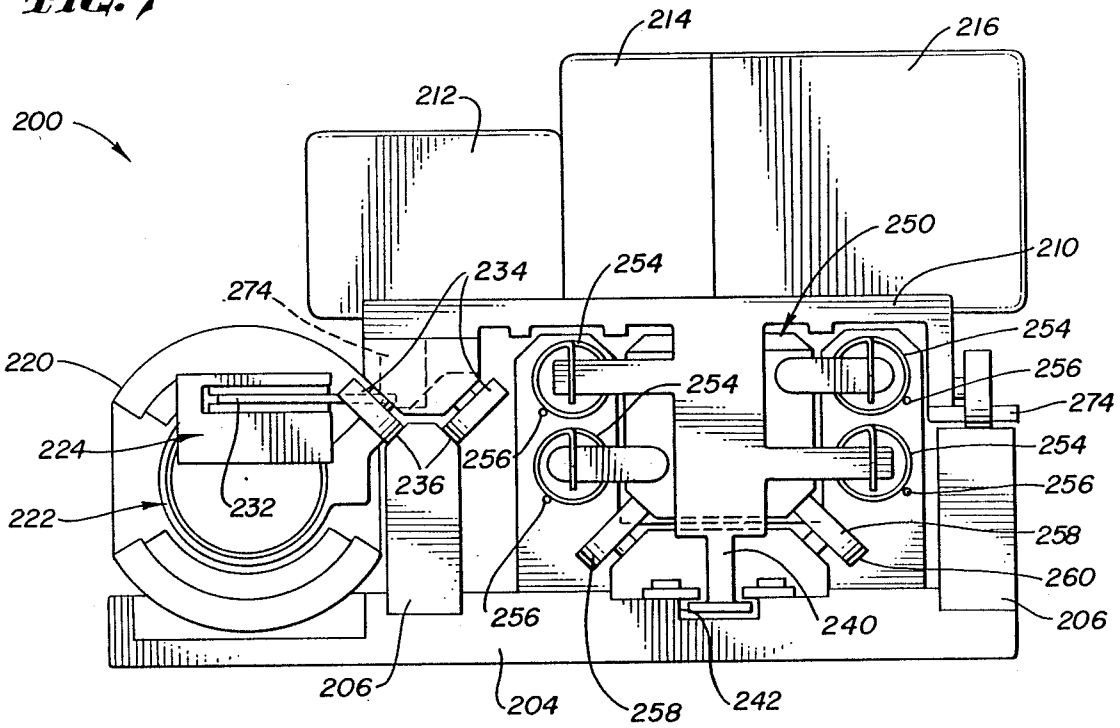
FIG. 7 is an end view of a third embodiment of the reciprocating shuttle mechanism of the present invention.
Figure 8:
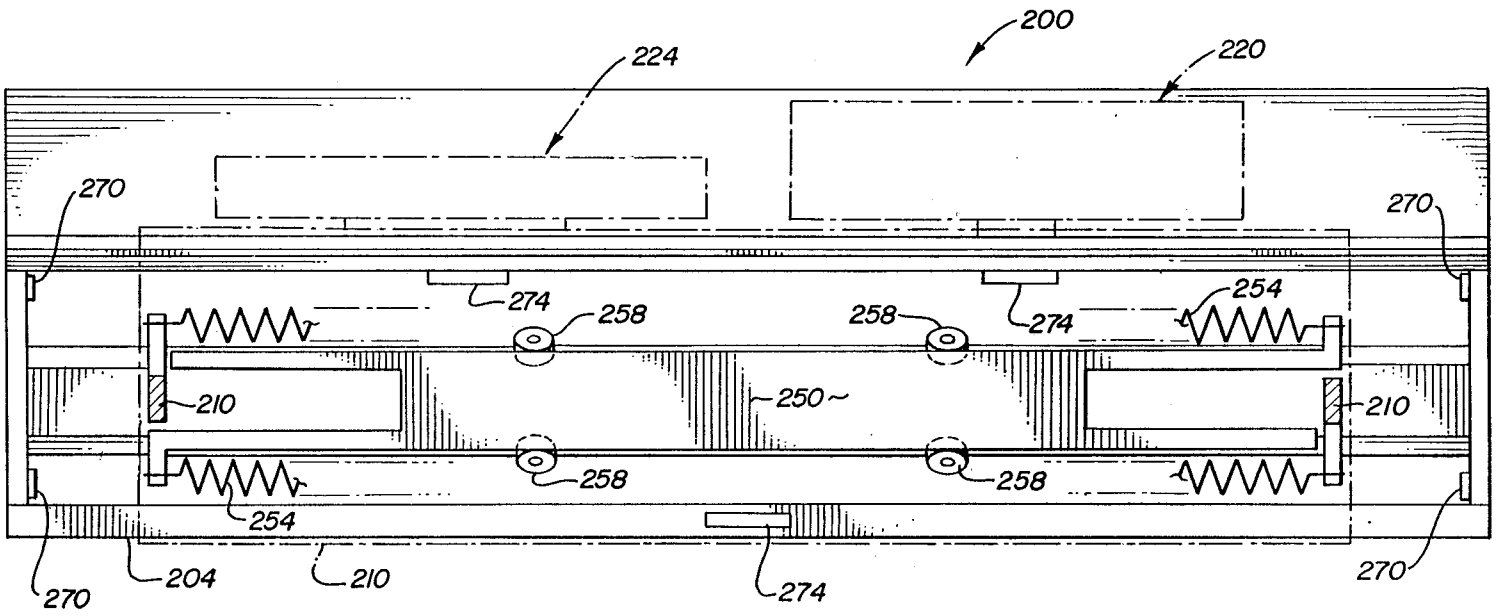
FIG. 8 is a top view of the reciprocating shuttle mechanism shown in FIG. 7.

FIGS. 7 and 8 depict end and top views, respectively, of a long-stroke reciprocating shuttle mechanism 200 according to a third embodiment of the present invention. The mechanism 200 operates in a fashion similar to that of the mechanisms 10 and 110 discussed above. The mechanism 200 includes a base 204 having support structures 206 mounted thereon. A shuttle carriage 210 and a plurality of print drivers 212, ink reservoirs 214, and ink jet printheads 216 mounted thereon substantially constitute the first mass of the shuttle mechanism 200. In alternate embodiments, other printing or plotting mechanisms may be mounted on the carriage 210.

The carriage 210 is urged into resonant oscillation, and thereafter maintained in resonant oscillation, by a motor 220 and a linear voice coil assembly 222. A position sensor 224 cooperates with a sensor fin 232 to sense the position of the carriage 210. Responsive to the sensed position, the carriage 210 is provided with a drive impetus by the motor 220 and coil assembly 222. A preferred method of maintaining resonant oscillation is discussed below with respect to the embodiment shown in FIGS. 1–4, and that method is also useful with respect to the embodiment shown in FIGS. 7 and 8.

Bearings 234 support the carriage 210 for linear movement on the support structures 206. The bearings 234 have rubber tires 236 to reduce noise and friction against the support structure 206. A carriage retainer post 240 riding in a channel 242 in the base 204 retains the carriage 210 on the base 204.

A second, counterbalancing mass 250 is connected to the carriage 210 by springs 254. Spring supports 256 damp transverse motion of the spring 254. Bearings 258 mounted on the base 204 support the counterbalancing mass 250 for linear reciprocal movement with respect to the base 204. Rubber tires 260 around the bearings 258 reduce noise.

In FIG. 8, the carriage 210 is depicted in outline form so that the underlying structure may be shown. Bumpers 270 mounted at the end of the area of linear travel of the carriage 210 are provided for emergencies such as a spring breakage or an obstruction of the movement of the reciprocating mass system. During normal operation, the carriage 210 does not come in contact with the bumpers 270. Three magnets 274 counteract any minor torques resulting from asymmetric application of forces to assist in retaining the carriage 210 on the rails 206. The magnets 274 assist in holding the carriage 210 on the support structure 206 in much the same fashion as the magnets 86 and 88 discussed above.

As shown in FIG. 7, two of the springs 254 are connected to a first end of the carriage 210. The other end of those two springs is connected to the counterbalancing mass 250. The other two springs are connected to the mass 250 at the end of the mass 250 adjacent the first end of the carriage 210. The other end of the second pair of springs is attached to the second end of the carriage 210. This arrangement is similar to the spring connection arrangement of the embodiment of the invention shown in FIGS. 1–4.

Figure 9:
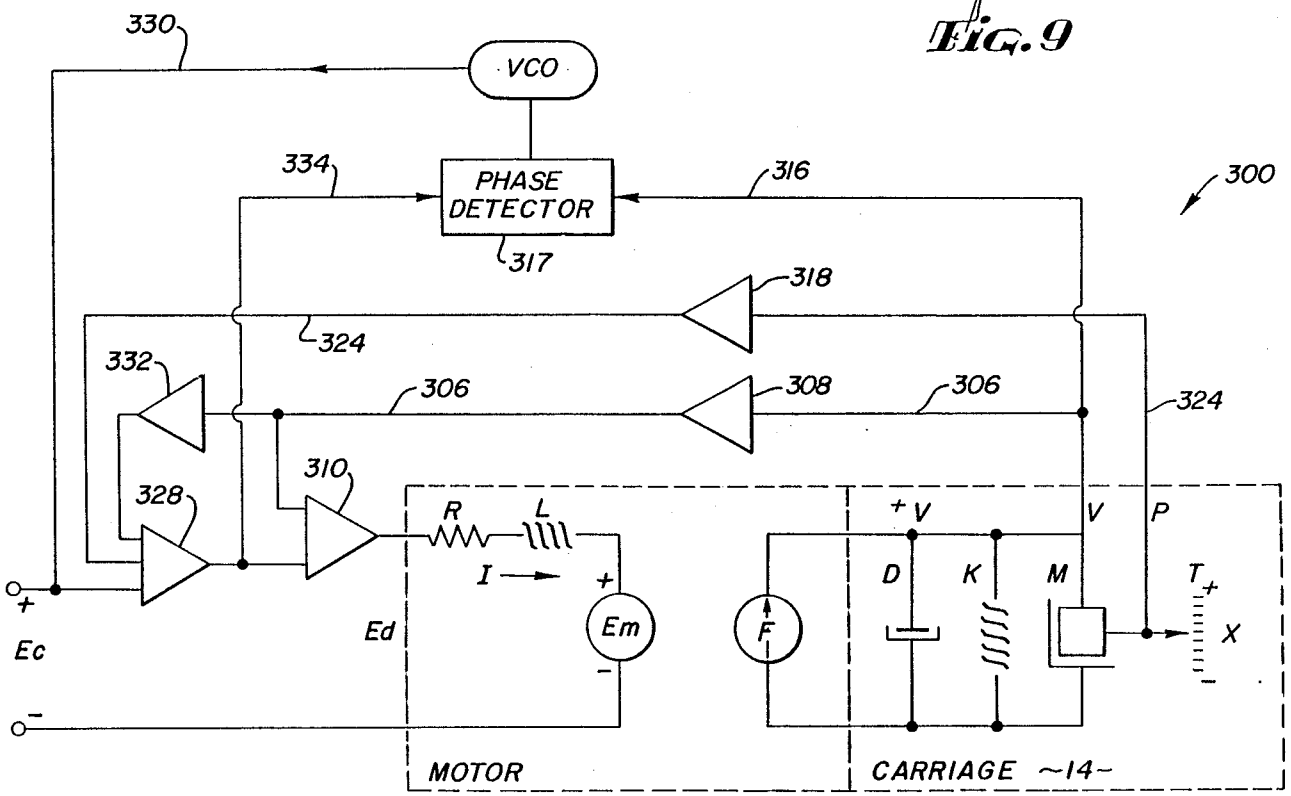
FIG. 9 is a block diagram of a feedback control circuit for control of the shuttle drive according to the present invention.

Referring now to FIG. 9, a feedback control circuit 300 for the present invention is shown in block diagram. The feedback control circuit 300 provides servo control of the position, velocity and frequency of the reciprocating shuttle. Therefore the shuttle is resistant to the effects of external disturbances both as to frequency and velocity of oscillation.

The control circuit 300 may be used in any of the described embodiments of the invention but for simplicity the circuit 300 is described only with respect to the embodiment depicted in FIGS. 1, 2, 3 and 4. The shuttle mechanism 10 of FIG. 1 is represented within the dotted-line block labelled SHUTTLE by a mechanical system comprising a mass M in parallel with a spring force K and in parallel with a dashpot D. The dashpot D represents the total loss due to frictional forces. A positional transducer T is illustrated as a recticular grating that measures the displacement X of the carriage 14. The positional transducer preferably includes the position sensor 68 and sensor fin 70.

A voltage representing the velocity signal V of the carriage 14 is derived, for instance, by differentiation of the position signal obtained from the position sensor 68.

The velocity signal V is applied by way of a lead 306 through an amplifier 308 of negative gain to a first summing junction amplifier 310. The output of the amplifier 310 is used to drive the motor 40. Thus the lead 306 provides a velocity control feedback loop.

The velocity signal V is simultaneously applied via a lead 316 as a first input to a PHASE DETECTOR 317. In the PHASE DETECTOR 317, the velocity signal V is compared to a generated sine wave control signal on the second input of the PHASE DETECTOR 317 as more fully described below.

The voltage proportional to the displacement position derived from the positional transducer T is applied as a position signal P via a lead 324 through an amplifier 318 of negative gain to one input of a second summing junction 328. The second input to the second summing junction 328 is a command voltage signal applied via a lead 330 from a voltage controlled oscillator VCO. The velocity signal V is applied through an amplifier 332 to the third input of the second summing junction 328. The output signal of the second summing junction 328 is a sine wave applied as the second input to the first summing junction 310 and as the second input to the PHASE DETECTOR via a lead 334. It can be seen that the lead 324 provides a positional control feedback loop.

In the PHASE DETECTOR 317, the phases of the control signal on the lead 334 and the velocity signal V on the lead 316 are compared and the voltage difference representing the phase difference is applied to the VCO to generate the command voltage signal.

At resonance, the output signal from the second summing junction 328 is in phase with the the velocity signal V on lead 316. When the carriage 14 is oscillating, the PHASE DETECTOR 317 detects any phase difference between the two signals and causes the voltage-controlled oscillator VCO to produce a command voltage signal in proportion to such detected difference, if any. This command voltage signal is applied via the lead 330 to the second input of the second summing junction 328, thereby creating a frequency feedback loop. The output of the second summing junction 328 and the amplified velocity signal V on the lead 306 are applied to the first summing junction 310 where the signals are compared to produce a voltage $E_d$ for driving the MOTOR.

The voltage output $E_d$ from the first summing junction 310 is fed to the MOTOR which is preferably the linear voice coil motor 40 of FIG. 2. The motor 40 is represented by a resistance R in series with an inductance L in series with the reverse voltage $E_m$ induced on the drive coil due to the motion of the carriage 14. The force F produced by the MOTOR in response to the voltage output $E_d$ oscillates the carriage 14. So long as the carriage is oscillating at the resonant frequency, the signals on the lines 334 and 316 will be in phase. If the carriage oscillation frequency should deviate from this resonant frequency, the VCO will drive the carriage 14 back to the resonant frequency.

The force F is applied from the motor 40 mounted on the mounting base 12. Thus, the force is applied to the carriage 14 by reference to the earth. As a result, the force causing the reciprocal motion of the carriage 14 is not affected by the motion of the counterbalancing mass 24.

Figure 10:
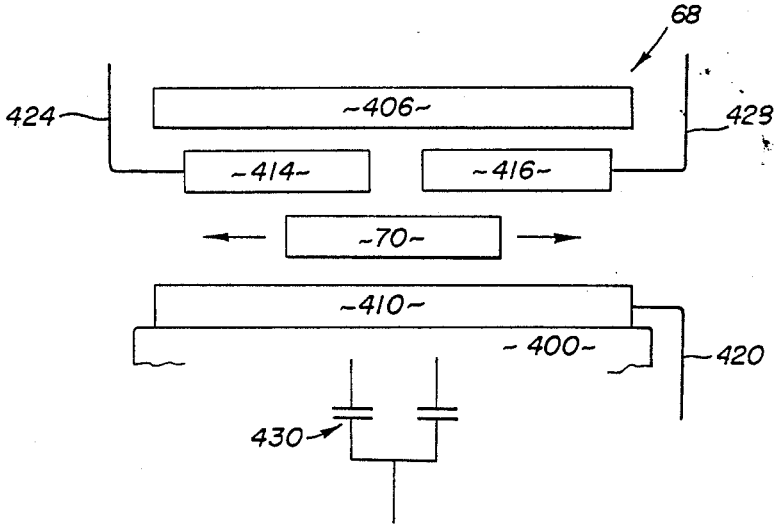
FIG. 10 is a side view of the position sensor of the shuttle drive according to one embodiment of the present invention.

Referring to FIG. 10, a side view of the position sensor 68 and sensor fin 70 of FIGS. 1–4 is shown. The sensor fin 70 comprises a metal plate that oscillates in the direction of the arrows along the length of the position sensor 68. The position sensor 68 comprises a lower base 400 and an upper base 406. Mounted on the lower base 400 is a unitary metal plate 410 that forms a capacitor plate. Mounted on the upper base 406 are two metal plates 414 and 416 that function as capacitor plates in combination with the plate 410. A lead 420 applies a potential to the unitary metal plate 410 and leads 424 and 426 apply potentials to the plates 414 and 416, respectively. The effective circuitry defined by the sensor 68 is shown in a block circuit diagram 430 in FIG. 10.

As the sensor fin 70 oscillates inside the position sensor 68, the respective capacitances between the plates 410, 414 and 416 varies in accordance with the proportion of the sensor fin 70 that is beneath each of the plates 414 and 416. The capacitances across the position sensor 68 are used to generate a signal (typically a sine wave) indicating the actual oscillating position of the shuttle 14. That signal is the position signal P of FIG. 9 and may be differentiated to provide the velocity signal V of FIG. 9.

The position and velocity feedback loops may alter the shape of the signals used to drive the phase detector because of distorted command drive signals, coulomb friction load variations, outside disturbances imposed on the shuttle and other such aberations. Distortions to the position command signal may be accommodated by filtering and providing an automatic level control. Distortions to the error signal resulting from load disturbances may be accommodated by providing an inner velocity feedback loop around the power amplifier. Other error signal distortions may be filtered by placing a filter on both phase detector inputs so both signals are shifted the same amount.

In using the printer 4 of the present invention, graphics presentations and color printing are limited only by the sophistication of the electronics actuating the printheads 18. The workpiece 8 encounters such modest stresses that it may be simultaneously printed on opposite sides by two shuttle mechanisms 10 constructed in accordance with the present invention. When electronics of sufficient speed and sophistication are employed, the performance limits of the mechanism 10 reside in the actuation frequency of, for instance, the ink jet print orifices and in the oscillatory velocities of the shuttle carriage 14. The velocities obtained by the shuttle mechanism 10 constructed in accordance with the present invention approach the maximum usable operational velocity of an ink jet orifice.

It will be appreciated that the present invention is not limited to the embodiments discussed herein but is capable of numerous modifications and rearrangements by those of skill in the art.

What is claimed:

1. An apparatus comprising:

a base;

a carriage mounted for reciprocating movement on said base;

means for movably supporting the carriage on the base with minimal resistance to linear oscillation of the carriage relative to the base;

at least one printhead mounted on the carriage;

a counterbalancing mass mounted on the base for reciprocating movement with respect to the carriage;

at least one spring interconnecting the carriage and the counterbalance mass a permit oscillatory movement of the carriage and the counterbalancing mass as a natural resonant frequency defined by the masses of the carriage and counterbalancing mass and the spring constant of the spring, wherein said at least one spring remains in expanded tension throughout the oscillation of the carriage and the counterbalancing mass; and drive means supported by the base and coupled to the carriage for imparting a variable force sufficient to maintain oscillation of the carriage and counterbalancing mass at substantially said natural resonant frequency.

2. The apparatus of claim 1 wherein the drive means further comprises:

position sensing means for sensing the position of the carriage relative to the base and providing a position signal indicative thereof;

a motor responsive to a motor control signal for supplying drive forces to the carriage relative to the base; and motor control circuit means responsive to the position sensing means for providing the motor control signal to the motor to cause the motor to induce and maintain oscillation of the carriage at said natural resonant frequency.

3. The apparatus of claim 2 wherein the motor further comprises a linear voice coil for supplying the drive forces to the carriage by electromagnetic coupling.

4. The apparatus of claim 2 wherein the motor control circuit means comprises a phase-locked loop for providing the motor control signal to the motor.

5. The apparatus of claim 1 wherein the printhead comprises at least one ink-jet printhead.

6. The apparatus of claim 1 wherein the carriage and the counterbalancing mass each have a first end and a second, opposite end, and wherein the at least one spring interconnecting the carriage and the counterbalancing mass comprise four springs, two of said springs being connected to the first end of said carriage and to the second, opposite end of the counterbalancing mass and the other two springs being connected to the second end of the carriage and to the first end of the counterbalancing mass.

7. The apparatus of claim 2 wherein the drive means controls the position, velocity and frequency of oscillation of the carriage.

8. The apparatus of claim 1 wherein the drive means comprises:

means for sensing the velocity of the carriage and providing a velocity signal proportional to the velocity of the carriage;

a first amplifier responsive to the velocity signal to provide a first polarity-reversed signal;

a first summing junction responsive to the first polarity-reversed signal from the first amplifier and to a summation signal to provide a drive signal;

means for sensing the position of the carriage and providing a position signal in accordance with the position of the carriage;

a second amplifier responsive to the velocity signal to provide a second polarity-reversed signal;

a second summing junction responsive to the second polarity-reversed signal from the second amplifier and to a command signal to provide the summation signal;

a phase-locked loop circuit comprising:

a phase detector responsive to the velocity signal and the summation signal to provide a phase difference signal proportional to the phase difference between the velocity signal and the summation signal; and a voltage controlled oscillator responsive to the phase difference signal for producing the command signal; and a motor responsive to the drive signal for inducing an appropriate mechanical force on the carriage and thereby causing the carriage to oscillate at said natural resonant frequency.

9. A resonant shuttle-assembly apparatus comprising:

a base adapted to hold a workpiece;

a shuttle adapted for linear oscillation, comprising:

a carriage; and a printhead supported on the carriage for acting upon a workpiece when linearly oscillate relative to the workpiece;

means for movably supporting the shuttle on the base with minimal resistance to linear oscillation of the shuttle relative to the base;

a counterbalancing mass adapted for linear oscillation;

spring means coupled between the counterbalancing mass and the shuttle to permit oscillatory movement of the shuttle and counterbalancing mass at a natural resonant frequency defined by the masses of the shuttle and the counterbalancing mass and the spring constant of the spring means so that the spring means couples through communicating spring forces the motion of the shuttle relative to the counterbalancing mass and the motion of the counterbalancing mass relative to the shuttle; and drive force means supported by said base for imparting a variable drive force impetus to the shuttle sufficient to induce and maintain an oscillation of the shuttle and the counterbalancing mass at substantially such natural resonant frequency;

wherein said spring means comprises at least one spring which remains in expanded tension throughout the oscillation of the shuttle and the counterbalancing mass.

10. The apparatus of claim 9 wherein the drive force means further comprises:

position sensing means for sensing the position of the shuttle relative to the base and providing a position signal indicative thereof;

a motor responsive to a motor control signal for supplying drive forces to the shuttle relative to the base; and motor control circuit means responsive to the position sensing means for providing the motor control signal to the motor to cause the motor to induce and maintain oscillation of the shuttle at said natural resonant frequency.

11. The apparatus of claim 10 wherein the motor comprises a linear voice coil for supplying drive forces to the shuttle by electromagnetic coupling.

12. The apparatus of claim 10 wherein the motor control circuit means comprises a phase-locked loop for providing the motor control signal to the motor.

13. The apparatus of claim 9 wherein the printhead comprises at least one ink-jet printhead.

14. The apparatus of claim 9 wherein the shuttle and the counterbalancing mass each have a first end and a second, opposite end, and wherein the spring means interconnecting the shuttle and the counterbalancing mass comprise four springs, two of said springs being connected to the first end of said shuttle and to the second, opposite end of the counterbalancing mass and the other two springs being connected to the second end of the shuttle and to the first end of the counterbalancing mass.

15. The apparatus of claim 10 wherein the drive means controls the position, velocity and frequency of oscillation of the carriage.

16. The apparatus of claim 9 wherein the drive means comprises:

means for sensing the velocity of the shuttle and providing a velocity signal proportional to the velocity of the shuttle;

a first amplifier responsive to the velocity signal to provide a first polarity-reversed signal;

a first summing junction responsive to the first polarity-reversed signal from the first amplifier and to a summation signal to provide a drive signal;

means for sensing the position of the shuttle and providing a position signal in accordance with the position of the shuttle;

a second amplifier responsive to the velocity signal to provide a second polarity-reversed signal;

a second summing junction responsive to the second polarity-reversed signal from the second amplifier and to a command signal to provide the summation signal;

a phase-locked loop circuit comprising:

a phase detector responsive to the velocity signal and the summation signal to provide a phase difference signal proportional to the phase difference between the velocity signal and the summation signal; and a voltage controlled oscillator responsive to the phase difference signal for producing the command signal; and a motor responsive to the drive signal for inducing an appropriate mechanical force on the shuttle and thereby causing the shuttle to oscillate at said natural resonant frequency.

17. The apparatus of claim 9 wherein the counterbalancing mass further comprises:

a first portion; and a second portion; and wherein the shuttle is positioned between the first and second portions and the spring means further comprises:

a first spring means for communicating first spring forces and coupling the motion of the shuttle relative to the first portion of the counterbalancing mass; and a second spring means for communicating second spring forces and coupling the motion of the shuttle relative to the second portion of the counterbalancing mass.

18. A resonant shuttle-assembly apparatus comprising:

a base adapted to hold a workpiece;

a counterbalancing mass being adapted for linear oscillation, and comprising a first portion having a hollow first cylinder with a first attachment point at one end and a second attachment point at the other and a second portion having a hollow second cylinder with a first attachment point at one end and a second attachment point at the other end;

a shuttle positioned between the first and second portions of the counterbalancing mass and adapted for linear oscillation, said shuttle having a carriage, a printhead supported on the carriage for acting upon a workpiece when linearly oscillated relative to the workpiece, a first end having an upper attachment point and a lower attachment point, and a second end having an upper attachment point and a lower attachment point;

means for movably supporting the shuttle on the base with minimal resistance to linear oscillation of the shuttle relative to the base;

spring means coupled between the counterbalancing mass and the shuttle to permit oscillatory movement of the shuttle and counterbalancing mass at a natural resonant frequency defined by the masses of the shuttle and the counterbalancing mass and the spring constant of the spring means so that the spring means couples through communicating spring forces the motion of the shuttle relative to the counterbalancing mass and the motion of the counterbalancing mass relative to the shuttle;

the spring means having a first spring means for communicating first spring forces and coupling the motion of the shuttle relative to the first portion of the counterbalancing mass, the first spring means comprising a first spring attached at one end tot he upper attachment point of the first end of the shuttle, extending internally through the first cylinder and attached at the other end to the first attachment point of the first cylinder, and a plurality of second springs each attached between the upper attachment point of the second end of the shuttle and the second attachment point of the first cylinder;

the spring means having a second spring means for communicating second spring forces and coupling the motion of the shuttle relative to the second portion of the counterbalancing mass, the second spring means comprising a first spring attached at one end to the lower attachment point of the first end of the shuttle, extending internally through the second cylinder and attached at the other end to the first attachment point of the second cylinder, and a plurality of second springs each attached between the lower attachment point of the second end of the shuttle and the second attachment point of the second cylinder; and drive force means fixed to said base for imparting a variable drive force impetus to the shuttle sufficient to induce and maintain an oscillation of the shuttle and the counterbalancing mass at substantially said natural resonant frequency.

19. An internally force-balancing shuttle-assembly apparatus comprising:

a base adapted to hold a workpiece;

a shuttle having a first end and a second, opposite end, comprising:

a carriage; and a printhead assembly fixedly supported on the carriage for acting upon a workpiece when linearly oscillated relative to the workpiece and the frame;

means for movably supporting the shuttle on the base with minimal resistance to linear oscillation of the shuttle relative to the base;

a counterbalancing mass adapted for linear oscillation in the same plane as the shuttle and having a first end and second, opposite end, corresponding to the first and second end of the shuttle;

four springs coupled between the counterbalancing mass and the shuttle, in expanded tension throughout the oscillation of the shuttle and the counterbalancing mass, to permit oscillatory movement of the shuttle and counterbalancing mass at a natural resonant frequency defined by the masses of the shuttle and the counterbalancing mass and the spring constant of the four springs so that the four springs couple through communicating spring forces the motion of the shuttle relative to the counterbalancing mass and the motion of the counterbalancing mass relative to the shuttle, two of said springs being connected between the first end of the shuttle and the second, opposite end of the counterbalancing mass, and the other two springs being connected between the second end of the shuttle and the first end of the counterbalancing mass; and electromagnetic drive means affixed to the base for imparting a variable electromagnetic drive force impetus to the shuttle sufficient to induce and maintain a long-stroke oscillation of the shuttle and counterbalancing mass at a natural resonant frequency.

20. The apparatus of claim 19 wherein the drive means further comprises:

means for sensing the displacement position of the shuttle relative to the base and providing a position signal indicative thereof;

a motor responsive to a motor control signal for supplying drive forces to the shuttle relative to the base; and motor control circuit means for providing the motor control signal to the motor to cause the motor to induce and maintain oscillation of the shuttle at said natural resonant frequency.

21. The apparatus of claim 20 wherein the motor comprises a drive coil for supplying the drive forces to the shuttle by electromagnetic coupling to minimize any forces coupled to the base through the drive means as a result of resonant linear oscillation of the shuttle.

22. The apparatus of claim 21 wherein the drive coil is of the linear voice coil type.

23. The apparatus of claim 20 wherein the motor control circuit means comprises a phase-locked loop for providing the motor control signal to the motor.

24. The apparatus of claim 20 wherein the drive means controls the position, velocity and frequency of oscillation of the carriage.

25. The apparatus of claim 19 wherein the four springs are linearly aligned and substantially surrounded by the counterbalancing mass.

26. An internally force-balanced shuttle-assembly apparatus comprising:

a base adapted hold a workpiece;

a shuttle having a first end and a second, opposite end, comprising:

a carriage; and a printhead assembly fixedly supported on the carriage for acting upon a workpiece when linearly oscillated relative to the workpiece and the frame;

means for movably supporting the shuttle on the base with minimal resistance to linear oscillation of the shuttle relative to the base;

a counterbalancing mass adapted for linear oscillation in the same plane as the shuttle and having a first end and a second, opposite end, corresponding to the first and second ends of the shuttle;

four springs coupled between the counterbalancing mass and the shuttle to permit oscillatory movement of the shuttle and counterbalancing mass at a natural resonant frequency defined by the masses of the shuttle and the counterbalancing mass and the spring constant of the four springs so that the four springs couple through communicating spring forces the motion of the shuttle relative to the counterbalancing mass and the motion of the counterbalancing mass relative to the shuttle, two of said springs being connected between the first end of the shuttle and the second, opposite end of the counterbalancing mass and the other two springs being connected between the second end of the shuttle and the first end of the counterbalancing mass; and electromagnetic drive means affixed to the base for imparting a variable electromagnetic drive force impetus to the shuttle sufficient to induce and maintain a long-stroke oscillation of the shuttle and counterbalancing mass at a natural resonant frequency; wherein the means for moveably supporting the shuttle comprises two bearings having an inverted V-shaped cross-section supporting one side of the shuttle and one bearing having a flat cross-section supporting the other side of the shuttle.

27. An internally force-balanced shuttle-assembly apparatus comprising:

a base adapted hold a workpiece;

a shuttle having a first end and a second, opposite end, comprising:

a carriage; and a printhead assembly fixedly supported on the carriage for acting upon a workpiece when linearly oscillated relative to the workpiece and the frame;

means for movably supporting the shuttle on the base with minimal resistance to linear oscillation of the shuttle relative to the base;

a counterbalancing mass adapted for linear oscillation in the same plane as the shuttle and having a first end and a second, opposite end, corresponding to the first and second end of the shuttle;

four springs coupled between the counterbalancing mass and the shuttle to permit oscillatory movement of the shuttle and counterbalancing mass at a natural resonant frequency defined by the masses of the shuttle and the counterbalancing mass and the spring constant of the four springs so that the four springs couple through communicating spring forces the motion of the shuttle relative to the counterbalancing mass and the motion of the counterbalancing mass relative to the shuttle, two of said springs being connected between the first end of the shuttle and the second, opposite end of the counterbalancing mass and the other two springs being connected between the second end of the shuttle and the first end of the counterbalancing mass; and electromagnetic drive means affixed to the base for imparting a variable electromagnetic drive force impetus to the shuttle sufficient to induce and maintain a long-stroke oscillation of the shuttle and counterbalancing mass at a natural resonant frequency;

wherein two of the four springs extend along one side of the counterbalancing mass and the other two springs extend along the other side of the counterbalancing mass.

28. The apparatus of claim 19 wherein the means for movably supporting the shuttle comprises two pairs of bearings on one side of the shuttle and two bearings on the other side of the shuttle and wherein the counterbalancing mass is supported for linear oscillation by two pairs of bearings mounted on the base.

29. The apparatus of claim 19 wherein the drive means comprises:

means for sensing the velocity of the shuttle and providing a velocity signal proportional to the velocity of the shuttle;

a first amplifier responsive to the velocity signal to provide a first polarity-reversed signal;

a first summing junction responsive to the first polarity-reversed signal from the first amplifier and to a summation signal to provide a drive signal;

means for sensing the position of the shuttle and providing a position signal in accordance with the position of the shuttle;

a second amplifier responsive to the velocity signal to provide a second polarity-reversed signal;

a second summing junction responsive to the second polarity-reversed signal from the second amplifier and to a command signal to provide the summation signal;

a phase-locked loop circuit comprising:

a phase detector responsive to the velocity signal and the summation signal to provide a phase difference signal proportional to the phase difference between the velocity signal and the summation signal; and a voltage controlled oscillator responsive to the phase difference signal for producing the command signal; and a motor responsive to the drive signal for inducing an appropriate mechanical force on the shuttle and thereby causing the shuttle to oscillate at said natural resonant frequency.

30. An internally force-balanced shuttle-assembly apparatus comprising:

a base adapted to hold a workpiece;

a shuttle having a first end with an upper attachment point and a lower attachment point and a second end with an upper attachment point and a lower attachment point and comprising:

a carriage; and a printhead fixedly supported on the carriage for acting upon a workpiece when linearly oscillated relative to the workpiece and the frame;

means for moveably supporting the shuttle on the base with minimal resistance to linear oscillation of the shuttle relative to the base;

a counterbalancing mass adapted for linear oscillation in the same plane as the shuttle and comprising:

a hollow first cylinder having a first attachment point at one end and a second attachment point at the other; and a hollow second cylinder having a first attachment point at one end and a second attachment point at the other end;

a first spring means for communicating first spring forces and coupling the motion of the shuttle relative to the first cylinder of the counterbalancing mass, comprising:

a first spring attached at one end to the upper attachment point of the first end of the shuttle, extending internally through the first cylinder and attached at the other end to the first attachment point of the first cylinder; and a plurality of second springs each attached between the upper attachment point of the second end of the shuttle and the second attachment point of the first cylinder;

a second spring means for communicating second spring forces and coupling the motion of the shuttle relative to the second cylinder of the counterbalancing mass, comprising:

a first spring attached at one end to the lower attachment point of the first end of the shuttle, extending internally through the second cylinder and attached at the other end to the first attachment point of the second cylinder; and a plurality of second springs each attached between the lower attachment point of the second end of the shuttle and the second attachment point of the second cylinder; and electromagnetic drive force means affixed to the base for imparting a variable electromagnetic drive force impetus to the shuttle sufficient to induce and maintain a long-stroke oscillation of the shuttle and counterbalancing mass at a natural resonant frequency.

31. The apparatus of claim 30 wherein the drive force means further comprises:

means for sensing the displacement position of the shuttle relative to the base and providing a position signal indicative thereof;

a motor responsive to a motor control signal for supplying drive forces to the shuttle relative to the base; and motor control circuit means for providing the motor control signal to the motor to cause the motor to induce and maintain oscillation of the shuttle at said natural resonant frequency.

32. The apparatus of claim 31 wherein the motor comprises a drive coil for supplying the drive forces to the shuttle by electromagnetic coupling to minimize any forces coupled to the base through the drive means as a result of resonant linear oscillation of the shuttle.

33. The apparatus of claim 32 wherein the drive coil is of the linear voice coil type.

34. The apparatus of claim 31 wherein the motor control circuit means comprises a phase-locked loop for providing the motor control signal to the motor.

35. The apparatus of claim 31 wherein the drive means controls the position, velocity and frequency of oscillation of the carriage.

36. The apparatus of claim 30 wherein the printhead comprises at least one ink-jet printhead.

37. The apparatus of claim 30 wherein the first cylinder is disposed above the shuttle and the second cylinder is disposed below the shuttle.

38. The apparatus of claim 30 wherein each of the springs is maintained in expanded tension during oscillation of the carriage and counterbalancing mass.

39. The apparatus of claim 30 wherein the drive means comprises:

means for sensing the velocity of the shuttle and providing a velocity signal proportional to the velocity of the shuttle;

a first amplifier responsive to the velocity signal to provide a first polarity-reversed signal;

a first summing junction responsive to the first polarity-reversed signal from the first amplifier and to a summation signal to provide a drive signal;

means for sensing the position of the shuttle and providing a position signal in accordance with the position of the shuttle;

a second amplifier responsive to the velocity signal to provide a second polarity-reversed signal;

a second summing junction responsive to the second polarity-reversed signal from the second amplifier and to a command signal to provide the summation signal;

a phase-locked loop circuit comprising:

a phase detector responsive to the velocity signal and the summation signal to provide a phase difference signal proportional to the phase difference between the velocity signal and the summation signal; and a voltage controlled oscillator responsive to the phase difference signal for producing the command signal; and a motor responsive to the drive signal for inducing an appropriate mechanical force on the shuttle and thereby causing the shuttle to oscillate at said natural resonant frequency.

* * * * *